US008087724B2

(12) United States Patent
Kosik et al.

(10) Patent No.: US 8,087,724 B2
(45) Date of Patent: Jan. 3, 2012

(54) ERGONOMIC COMPUTER CHAIR

(75) Inventors: Leonid Andreevich Kosik, Moscow (RU); Aleksey Leonidovich Kosik, Moscow (RU); Taras Leonidovich Kosik, Moscow (RU); Sergey Alexandrovich Telnov, Moscow (RU)

(73) Assignee: Gravitonus Inc., Fairfax, VA (US)

( * ) Notice: Subject to any disclaimer, the term of this patent is extended or adjusted under 35 U.S.C. 154(b) by 261 days.

(21) Appl. No.: 12/538,188

(22) Filed: Aug. 10, 2009

(65) Prior Publication Data

US 2011/0031788 A1 Feb. 10, 2011

(51) Int. Cl.
*A47C 7/62* (2006.01)

(52) U.S. Cl. ..... 297/217.3; 297/325; 297/170

(58) Field of Classification Search .... 297/217.1–217.4, 297/325, 330, 170, 172
See application file for complete search history.

(56) References Cited

U.S. PATENT DOCUMENTS

| | | | | |
|---|---|---|---|---|
| 1,829,614 | A * | 10/1931 | Schier | 33/275 R |
| 3,653,125 | A * | 4/1972 | Heubeck | 433/33 |
| 4,470,631 | A * | 9/1984 | Powell | 297/184.11 |
| 4,941,709 | A * | 7/1990 | Moller | 297/325 |
| 5,489,142 | A * | 2/1996 | Mathieu | 297/327 |
| 6,012,774 | A * | 1/2000 | Potter | 297/325 |
| 6,056,363 | A * | 5/2000 | Maddox | 297/325 |
| 6,382,725 | B1 * | 5/2002 | Carroll | 297/330 |
| 6,450,578 | B1 * | 9/2002 | Taggett | 297/325 |
| 6,823,549 | B1 * | 11/2004 | Hampton et al. | 5/713 |
| 7,134,719 | B2 * | 11/2006 | Moglin et al. | 297/217.3 |
| 2007/0106184 | A1 * | 5/2007 | Richard Vitton | 601/86 |
| 2009/0206641 | A1 * | 8/2009 | Brown, Jr. | 297/217.3 |

* cited by examiner

*Primary Examiner* — David Dunn
*Assistant Examiner* — Erika Garrett
(74) *Attorney, Agent, or Firm* — Defillo & Associates, Inc.; Evelyn A. Defillo

(57) ABSTRACT

The present ergonomic computer chair relates to chairs for special purposes, and more particularly, to computer operator's chair which is ergonomically designed to prevention of orthopedic and cardiovascular diseases and creation of psychophysical comfort, especially as regards reduction of fatigability during long-lasting work with computer. The ergonomic computer chair includes a seat with a backrest and a pedestal with a support frame made in the circular arc form, a support ring installed on the support frame wherein said support ring can rotate around its axis. The backrest is made of a rigid part and an elastic part separated from one other by at least three elastic bladders connected to a compressor by air tubes having electric valves. The rigid part of the backrest is hinged to the seat, and the seat is hinged to a seat inclination drive and to a footrest. A mounting of the computer monitor and keyboard is made by means of a movable sector which is made as a arched pipe with centering bearings. The chair has electric drives to move the support ring along the support frame of the pedestal, to move the movable sector along the support ring, to move the monitor longitudinally and to control monitor's inclination. This makes it possible to change the user's body position within the space against the Earth's gravitational field vector during the entire time of the work with computer. The use of the proposed device reduces the probability of orthopedic diseases occurrence, creates comfort and increases efficiency of the computer user.

10 Claims, 3 Drawing Sheets

C - 55° -60°

Th +60° +70°

L +40° +50°

C +55° +65°

Th - 20° - 30°

L +25° +35°

C +10° +20°

Th +75° +80°

L -35° -45°

ERGONOMIC COMPUTER CHAIR

TECHNICAL FIELD

The invention is of medical nature, in particular it relates to prevention of orthopedic, and cardiovascular diseases and creation of psychophysical comfort, especially as regards reduction of fatigability during long-lasting work with computer.

BACKGROUND OF THE INVENTION

A modern person spends most of his or her active time seating. While seating and working with the computer the person does not move spinal articulations properly. Usually he seats in front of a monitor in a pose when thoracic and lumbar spine articulations are bent to the maximum while cervical spine articulations are straightened as much as possible. Such pose is very comfortable and convenient, since requires no physical efforts to retain or cerebration to control body position, which creates optimal conditions for intellectual work. But lack of full-scale movements of spinal articulations with time results in development of degenerative-dystrophic changes in spines mentioned above. In the future it may lead to development of kyphosis, osteochondrosis, spondylarthrosis and visceral function disorders. Different conventional computer chairs are is fact spine articulations fixators.

It is known the ergonomic chair comprising a seat with a backrest, a pedestal with arched support elements arranged to oscillate around horizontal axis. The seat is pivotally coupled to the support elements and the backrest is fixedly attached to the support elements. An equipment desk for a computer keyboard, monitor and illuminating lamps are also coupled to the support elements (Patent CA No. 2,391,639, Patent RU No. 2,209,022). But, there is a problem with the chair described in said patents that it cannot maintain in use a mobility of spinal articulations.

It is known also the ergonomic computer chair comprising a pedestal with an arched support frame, a support ring installed on the support frame, wherein the ring can rotate around its axis, the seat with the backrest, the monitor, and the keyboard which are all coupled to the support ring (Patent RU No. 2,290,157). But, the device described in the patent RU No. 2,290,157 provides for change of positions of the ergonomic computer with the seated person, while the spinal articulations remain immovable against each other.

SUMMARY OF THE INVENTION

The object of the present invention is to provide a device allowing to sustain mobility of spinal articulations throughout the entire time of computer operations (which is not proposed by the known technical concepts), reduce the probability of orthopedic diseases occurrence, lower the fatigability and therefore increase the efficiency of the working person.

Thus the technical result is to reduce the probability of orthopedic diseases occurrence, create comfort and increase efficiency of the man using the proposed device.

Said technical result is achieved by the fact that the ergonomic computer chair has a pedestal with the support frame made in the circular arc form, the support ring installed on the support frame wherein said support ring can rotate around its axis, the seat with the backrest, the monitor and the keyboard coupled to the support ring. According to the invention, the support frame is made of an arched pipe with two centering bearings fastened therein at two opposite ends for movably mounting said ring into said frame. The seat backrest is made of a rigid part and an elastic part separated each from other by at least three elastic bladders connected by means of air tubes equipped with electrical valves to a compressor all placed between said rigid and elastic parts. The rigid part of the backrest is hinged to the seat, and the seat is hinged to a seat inclination drive and to a footrest.

A mounting of the monitor and keyboard is made by means of movable sector which is made of the arched pipe with two centering bearings fastened therein at two opposite ends for movably mounting said sector around said ring. The movable sector is equipped by electric drives to move the sector along the ring, to move the monitor longitudinally and to control monitor's inclination controlled by a sensor located on the monitor.

It is provided that the ring's movement within the support frame can be done using electric drive located within the pedestal and having retractable rod in a hinged connection with the ring.

Besides, the pedestal also includes: a power supply unit, an audio amplifier and a computer system unit connected by electrical conductors which pass subsequently through the through groove in the support frame and holes in the ring, through the ring itself and via exit holes are routed to the compressor, valves, loud speakers and lighting elements, and through the through groove of the movable sector to the monitors and electric drives.

It is recommended that the mean radius of the support frame and the mean radius of the movable sector are equal to the mean radius of the support ring.

DESCRIPTION OF THE PREFERRED EMBODIMENT

Figure 1:
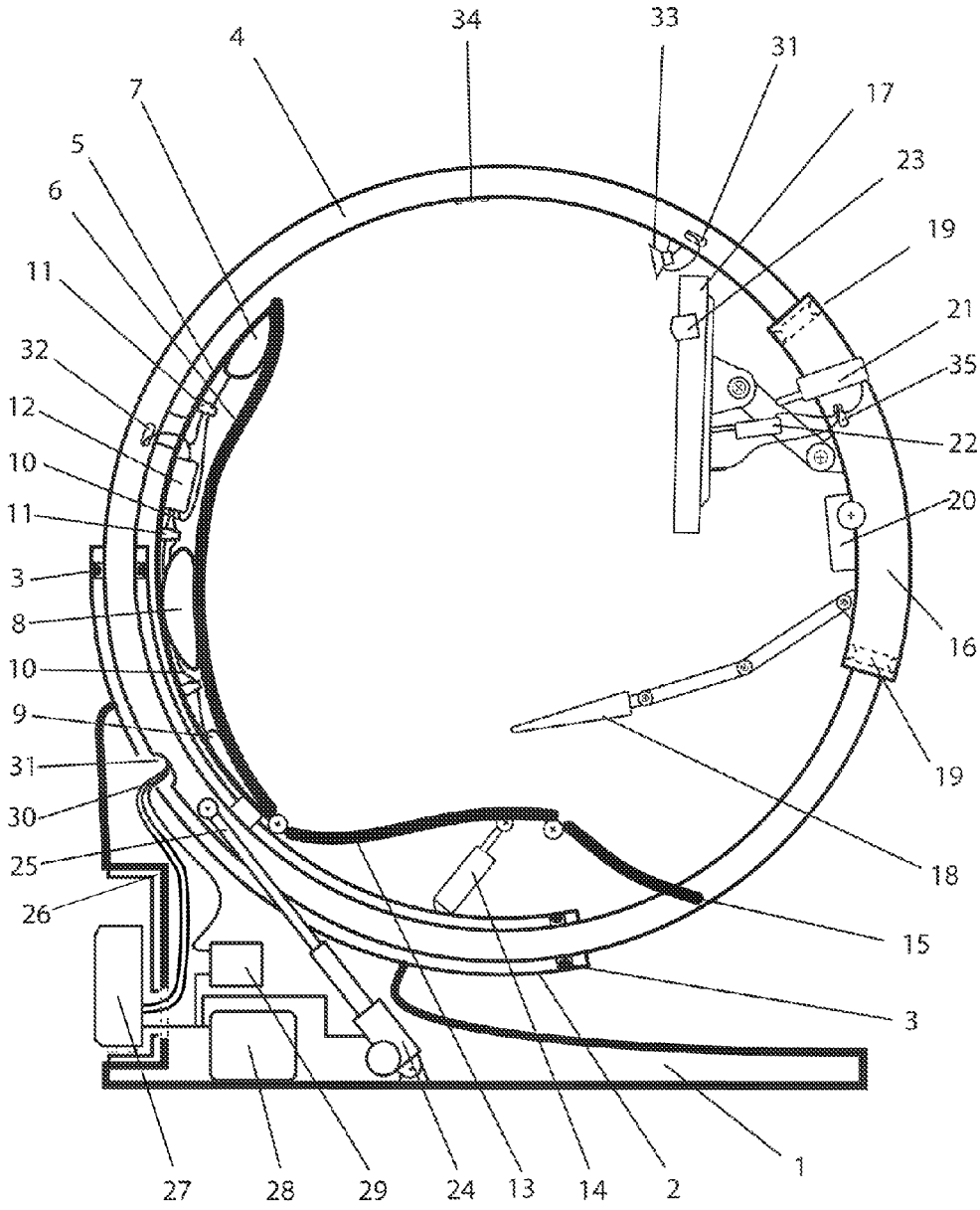
FIG. 1 is a side view partly in cross-section of the support frame and seat backrest of the ergonomic computer chair formed in accordance with the present invention.

Ergonomic computer chair comprises a pedestal (1), a support frame (2) fixed on the pedestal (1), and a support ring (4) equipped with a seat (13), and a seat backrest comprising a rigid part (5) and an elastic part (6). The support frame (2) is made of an arched pipe with two centering bearings (3) fastened therein at two opposite ends for movably mounting the ring (4) into the frame (2).

Parts (5, 6) of the backrest are separated from one another by at least three elastic bladders—upper bladder (7), middle bladder (8) and lower bladder (9). The bladders are connected to a compressor (12) by air tubes (10) having electric valves (11). The rigid part (5) of the backrest is hinged to the seat (13) which in its turn is hinged to the seat incline drive (14)

and the footrest (15). Besides, the seat (13) and the footrest (15) are also hinged one to another by an electric drive (38).

The support ring (4) is also provided with a movable sector (16) made of the arched pipe with two centering bearings (19) fastened therein at two opposite ends for movably mounting the sector (16) around the ring (4). The movable sector (16) holds a monitor (17), and a computer keyboard (18) as well as an electric drive (20) to move the movable sector (16) along the ring (4), an electric drive (21) to move the monitor (17) longitudinally, and electric drive (22) to control monitor inclination controlled by a sensor (23) placed on the monitor (17).

It is provided that the support ring (4) movement within the support frame (2) can be done using electric drive (24) located within the pedestal (1) and having retractable rod (25) pivotally connected with a bracket (37) of the ring (4).

The pedestal (1) also includes: a niche (26) to accommodate a computer system unit (27), a power supply unit (28), and an audio amplifier (29) connected with electric conductors (30) passing through a through groove (36) in the support frame (2) and a hole (31) in the ring (4). Then the conductors (30) are passed inside the ring (4) itself and directed to a compressor (12), electric valves (11), a loud speaker (33) and illuminating lamps (34) through exit holes (32).

The conductors (30) are also routed to the monitor (17) and the electric drives (20, 21, 22) of the movable sector (16) through the hole (32) in the ring (4) and the through groove (35) in the movable sector (16).

Preferably, the mean radius of the support frame (2) and the mean radius of the movable sector (16) both are substantially equal to a mean radius of the ring (4).

The device is operated in the following manner.

The user is seated on the seat (13). When fatigue signs due to immovable position of spinal articulations are starting to show, the positions of the elastic part (6) of the backrest and the ring (4) is smoothly changed against the Earth's gravitational field vector to a certain extent along with the installed equipment and the user seated in it.

Figure 2:
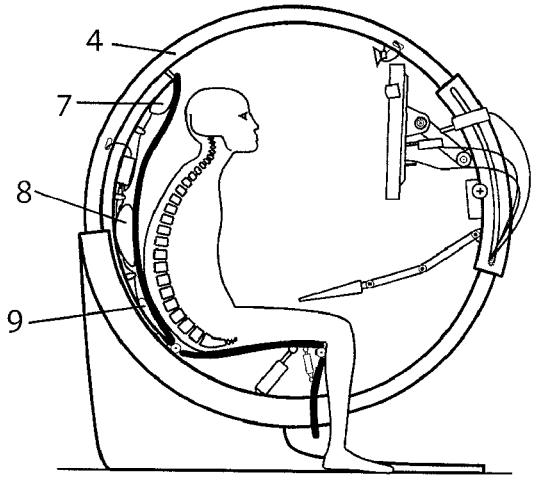
FIG. 2 is a pictorial view of the ergonomic computer chair in accordance with the present invention in the sitting position.
Figure 5:
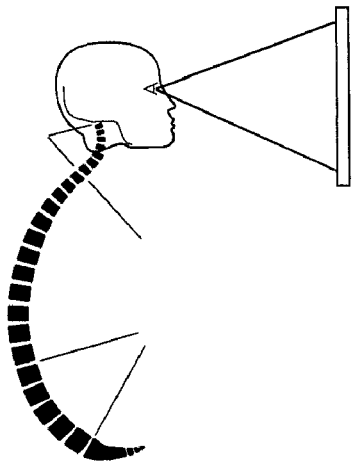
FIGS. 5, 6 and 7 are diagrams illustrating relative positions of spinal articulations in said three positions of the ergonomic computer chair in accordance with the present invention.

For example, before the computer user starts his work, the ring (4) is installed in home position as shown in FIG. 2 and amounts of air inside the upper bladder (7), middle bladder (8), and lower bladder (9) correspond to the minimal preset values, while the form of the elastic part (6) of the backrest corresponds to the relaxed posture of the seating user. The user sits down on a seat relaxed: a lower section of the elastic part (6) of the backrest supports the body in equilibrium. This posture (FIG. 5) allows the user to unbend cervical spine articulations (C) to the maximum of 55°-60°, bend thoracic spine articulations (Th) to 60°-70° and lumbar spine articulations (L) to 40°-50°. The user turns on the power supply unit (28) on (FIG. 1), places the keyboard (18) in the most comfortable position and, using the computer system unit (27), commands the electric drive (21), that locates the monitor (17) along longitudinal axis to set the optimal eye-to-screen distance; commands the electric drive (22) to set the optimal inclination of the monitor (17) and inputs these data into the memory of the computer processor. Then the user starts working.

Figure 3:
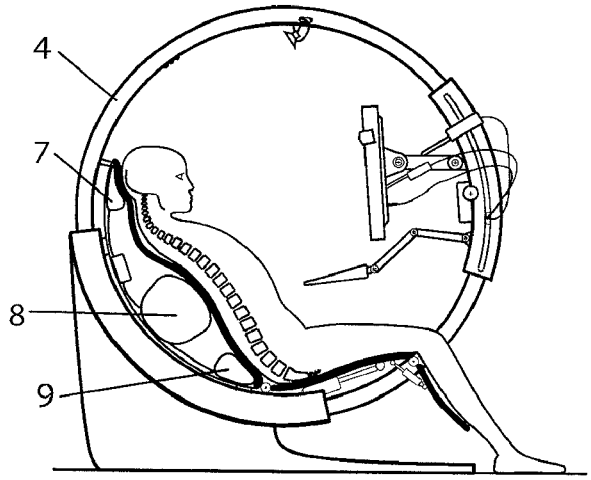
FIG. 3 is a pictorial view of the ergonomic computer chair in accordance with the present invention in the semirecumbent position.
Figure 4:
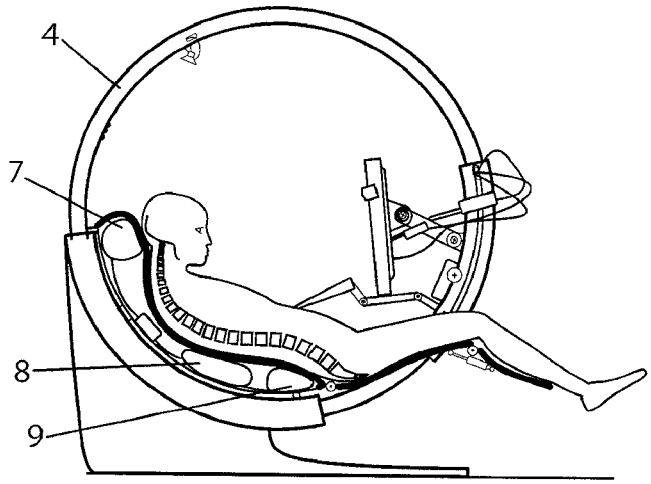
FIG. 4 is a pictorial view of the ergonomic computer chair in accordance with the present invention in the recumbent position.
Figure 6:
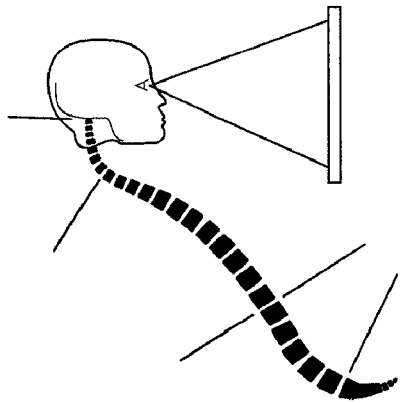

After a certain time, due to immovable position of spinal articulations and impact of gravitational field the user starts feeling the growing bodily fatigue, sings of which are expressed through intensified muscular activity, aimed at body position change. Higher amplitude and movement frequency are picked by the sensor (23), which sends pulses as electric signals into the computer system unit (27). Input signals are analyzed by the computer using in-built programs which forms output signals resulting in consistent actuations of the compressor (12), electric valves (11) and electric drives (14, 20, 21, 22, 24, 38). The started electric drive (24) forces the rod (25) to rotate the ring (4) along with the user and place him in semirecumbent position (FIG. 3). At the same time, the compressor fills up the middle bladder (8) completely and fills up the lower bladder (9) to 30-50%, keeping the bladder (7) empty, since electric valve (11) cuts the air inlet, while electric drive (20) moves the movable sector (16) down over the ring (4). This movement increases the eye-to-screen distance which is immediately picked up by the sensor (23) and the computer system unit (27) switches to start the electric drive (21) and bring the monitor closer until the preset distance is reached. Expanding bladders cause the elastic part (6) of the backrest to change its form, at the same time the pressing force of the gravitational field changes the form of the spine as well as interlocation of spinal articulations of the user: cervical spine articulations (C) bend to 55°-65°, thoracic spine articulations (Th) unbend to 20°-30° while lumbar spine articulations (L) bend to 25°-35° (FIG. 6). After a certain time in this position (FIG. 3) the user starts again to feel growing bodily fatigue requiring changing of the interlocation of spinal articulations and body location relative to the gravitational field. Depending on the processor's program or wish of the user, the ergonomic computer chair can be either returned to the sitting position (FIG. 2) or set into the recumbent position (FIG. 4). Hereat, the processor switches the electric drive (24) on and drives the ring (4) to rotate along with the user to lay him down (FIG. 4).

Figure 7:
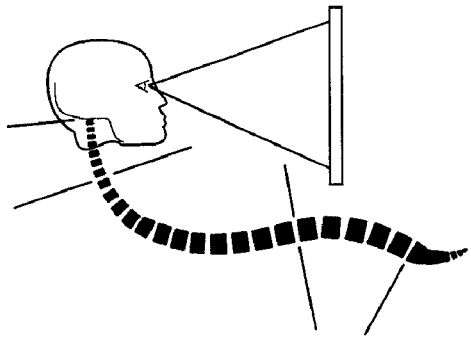

At the same time, the compressor fills up the upper bladder (7) completely, fills the middle bladder (8) up to 20-30% and the lower bladder (9) completely (FIG. 4), while the electric drive (20) moves the sector (16) along the ring (4) downwards, thus reducing the eye-to-screen distance and the monitor inclination to be picked up by the sensor (23) which, using the computer system unit (27), starts the electric drive (21) to reach the preset distance, and electric drive (22) to set the preset inclination of the monitor. Change of the bladders' (7, 8, 9) volume results in the changed form of the elastic part (6) of the backrest, and at the same time the pressing force of the gravitational field changes the form of the spine as well as interlocation of spinal articulations of the user: cervical spine articulations (C) bend to 10°-20°, thoracic spine articulations (Th) bend to 75°-85° and lumbar spine articulations (L) unbend to 35°-45° (FIG. 7).

As shown in the FIG. 4, the inclination angle of the seat (13) against the rigid part (5) of the backrest and the angle of the footrest (15) against the seat (13) change depending on a ring rotation angle.

The said technical result is achieved through mechanical bending and unbending of spinal articulations and change of the user's body position within the space against the Earth's gravitational field vector during the entire time of the work with computer either in manual mode or using the special program input earlier; while optimal "man-machine" parameters set initially remain unchanged.

What is claimed is:

1. An ergonomic computer chair comprising:

a pedestal with an arched support frame;

a support ring installed on the support frame, wherein the support ring can rotate around its axis;

a seat with a backrest;

a monitor; and a computer keyboard which are all coupled to the support ring, wherein the support frame is made of an arched pipe with two centering bearings fastened therein at two opposite ends for movably mounting said ring into said frame;

wherein the backrest of the seat is made of a rigid part and an elastic part separated from one another by at least three elastic bladders connected by means of air tubes equipped with electrical valves to a compressor placed between said rigid and elastic parts;

wherein the coupling of said monitor and keyboard to said ring is realized by means of a movable sector which is made of the arched pipe with two centering bearings fastened therein at two opposite ends for movably mounting said sector around said ring; and wherein said ring is hollow, and electrical conductors are passed through said hollow ring in the direction from a power supply unit, said computer system unit and an audio amplifier to said compressor, monitor, electric drives, electric valves, illuminating lamps and loud speakers.

2. The chair according to claim 1, wherein a mean arc radius of said arched pipes is substantially equal to a mean radius of said ring.

3. The chair according to claim 2, which is provided by an electric drive to move said movable sector along said ring, an electric drive for longitudinal monitor movements and an electric drive controlling monitor inclination.

4. The chair according to claim 3, wherein said pedestal comprises a niche to accommodate a computer system unit.

5. An ergonomic computer chair comprising:

a pedestal with an arched support frame;

a support ring installed on the support frame, wherein the support ring rotates around an axis;

a seat with a backrest connected to the support ring;

a monitor connected to the support ring; and a computer keyboard connected to the support ring;

wherein the support frame is made of an arched pipe having two bearings fastened therein at two opposite ends for movably mounting the support ring into the frame;

wherein the backrest of the seat is made of a rigid part and an elastic part separated from one another by at least three elastic bladders, wherein the elastic bladders are connected by air tubes equipped with electrical valves to a compressor placed between the rigid and elastic parts;

wherein when fatigue signs due to immovable position of spinal articulations are starting to show, expanding the bladders causes the elastic part of the backrest to change its form, at the same time the pressing force of the gravitational field changes the form of the spine of a user of the seat.

6. The chair according to claim 5, wherein the connection of the monitor and the computer keyboard to the support ring is realized by a movable sector made of an arched pipe, the movable sector having opposite ends fastened to the bearings for movably mounting the movable sector around the support ring.

7. The chair according to claim 6, wherein a mean arc radius of the arched pipe is substantially equal to a mean radius of the support ring.

8. The chair according to claim 6, further comprising an electric drive to move the movable sector along the support ring, an electric drive for longitudinal monitor movements and an electric drive controlling monitor inclination.

9. The chair according to claim 5, wherein the pedestal comprises a niche to accommodate a computer system unit.

10. The chair according to claim 5, wherein the support ring is hollow, and wherein electrical conductors are passed through said hollow ring in the direction from a power supply unit, said computer system unit and an audio amplifier to said compressor, monitor, electric drives, electric valves, illuminating lamps and loud speakers.

* * * * *